US008763840B2

(12) United States Patent
Oliveri et al.

(10) Patent No.: US 8,763,840 B2
(45) Date of Patent: Jul. 1, 2014

(54) LITTER RECEPTACLE

(75) Inventors: Michael Oliveri, Athens, GA (US); Deirdre L. Dunphy, Athens, GA (US); Robert Carl Martin, Athens, GA (US); Lou Ellen Kregel, Athens, GA (US); Michael S. Lachowski, Athens, GA (US); Carol Elisabeth John, Athens, GA (US)

(73) Assignee: University of Georgia Research Foundation, Athens, GA (US)

( * ) Notice: Subject to any disclaimer, the term of this patent is extended or adjusted under 35 U.S.C. 154(b) by 734 days.

(21) Appl. No.: 12/389,953

(22) Filed: Feb. 20, 2009

(65) Prior Publication Data

US 2009/0212055 A1 Aug. 27, 2009

Related U.S. Application Data

(60) Provisional application No. 61/066,847, filed on Feb. 22, 2008.

(51) Int. Cl.
*B65D 25/22* (2006.01)

(52) U.S. Cl.
USPC ..... 220/475; 220/478; 220/751

(58) Field of Classification Search
USPC ..... 220/475, 478, 911, 751, 810, 479; 206/246, 296; 248/141
See application file for complete search history.

(56) References Cited

U.S. PATENT DOCUMENTS

| | | | | | |
|---|---|---|---|---|---|
| 1,082,550 | A * | 12/1913 | Peters | ..... | 220/479 |
| 2,575,441 | A * | 11/1951 | Burnett | ..... | 220/478 |
| 3,190,483 | A * | 6/1965 | Robie et al. | ..... | 220/478 |
| 4,765,346 | A * | 8/1988 | Simin | ..... | 131/231 |
| 4,860,909 | A * | 8/1989 | Leumi | ..... | 220/475 |
| 4,925,072 | A * | 5/1990 | Masler et al. | ..... | 224/282 |
| 5,213,294 | A * | 5/1993 | DeBord | ..... | 248/147 |
| 6,789,677 | B2 * | 9/2004 | Maietta | ..... | 206/536 |

* cited by examiner

*Primary Examiner* — Jeffrey Allen
(74) *Attorney, Agent, or Firm* — Thomas|Horstemeyer, LLP

(57) ABSTRACT

A litter receptacle system, including: a support frame; a container for receiving and storing litter; a coupler; and a retention device; wherein the coupler rotatably couples the container to the support frame; the retention device is in communication with the support frame and the container; and the retention device is operable to releasably secure the container to the support frame, and a method of using the same.

10 Claims, 7 Drawing Sheets

LITTER RECEPTACLE

CROSS-REFERENCE TO RELATED APPLICATION

This application claims priority to and the benefit of U.S. provisional application entitled, "Cigarette Litter Receptacle," having Ser. No. 61/066,847 filed Feb. 22, 2008 which is entirely incorporated herein by reference.

BACKGROUND

The present disclosure relates to litter receptacle systems. A litter receptacle system typically includes an open top container for the disposal of litter, including extinguished cigarettes.

SUMMARY

Embodiments of the present disclosure are related to litter receptacle systems, assemblies and methods.

Briefly described, one embodiment, among others, comprises a litter receptacle system. In an exemplary embodiment the litter receptacle system includes: a support frame for receiving and holding litter; a container; a coupler; and a retention device; wherein the coupler rotatably couples the container to the support frame, the retention device is in communication with the support frame and container, and the retention device is operable to releasably secure the container to the support frame to prevent rotation of the container with respect to the support frame when the retention device operates to secure the container to the support frame.

Another embodiment, among others, comprises a method for litter disposal. In an exemplary embodiment the method for litter disposal includes: providing a litter receptacle including a support frame, a container for receiving and storing litter, the container rotatably coupled to the support frame, and a retention device for releasably securing the container to the support frame, preferably in a substantially upright position; disengaging the retention device from the container; rotating the container to an inverted position; emptying the container; rotating the container back into a substantially upright position; and employing the retention device to re-engage the container to said support frame.

Another exemplary embodiment of the method of the present invention further includes: providing an extinguisher in connection with the container; extinguishing a cigarette, or other lit smoking product, by pressing or rubbing the lit end of the product against the extinguisher; dropping the product into the container; disengaging the retention device from the container; rotating the container into an inverted position; emptying the container; rotating the container back to a substantially upright position; and employing the retention device to re-engage the container in said substantially upright position.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
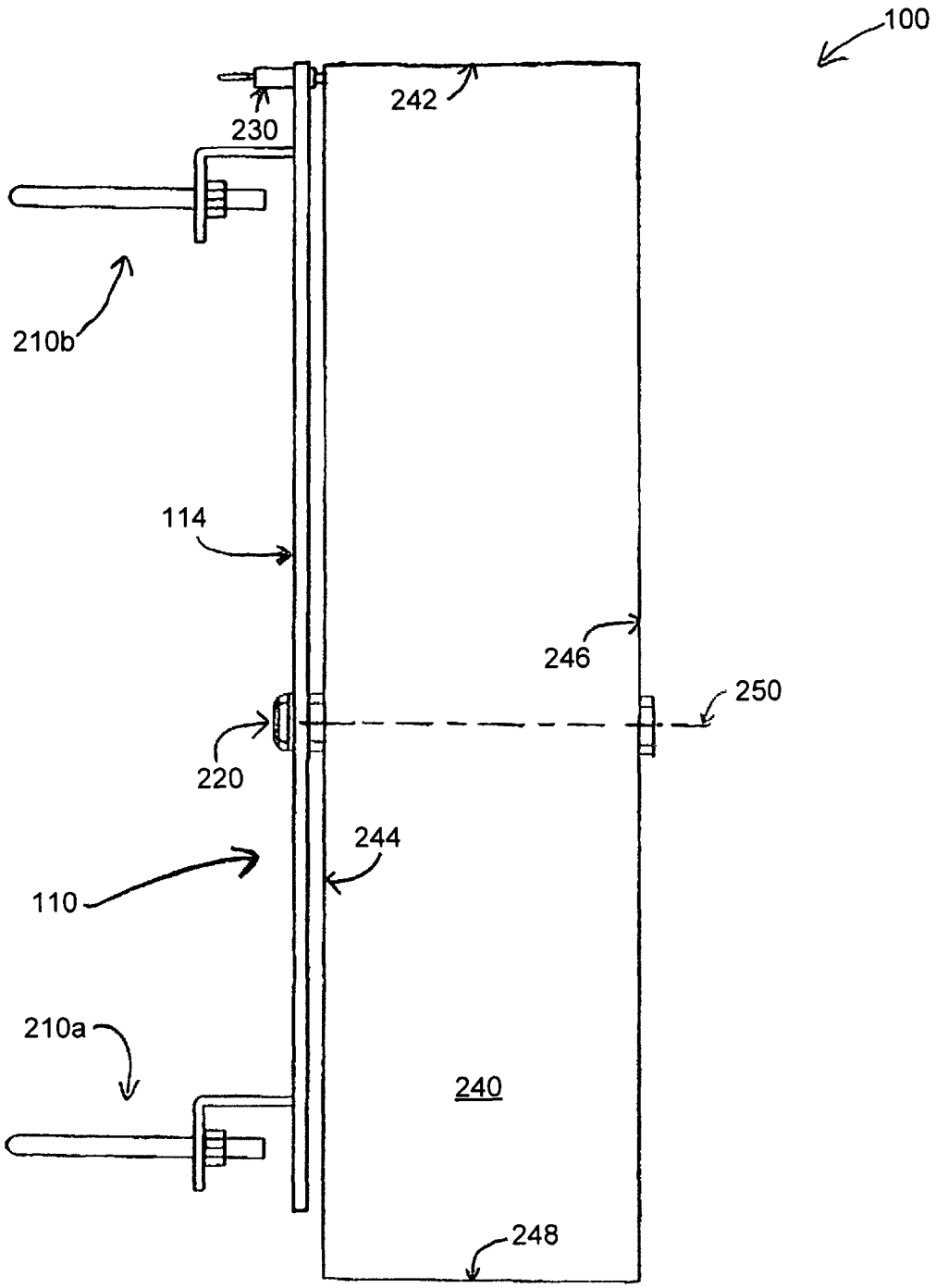
FIG. 1 is a side view of an exemplary embodiment of a litter receptacle of the present disclosure.

Disclosed herein are various embodiments of systems, assemblies, and methods related to litter receptacles. Reference will now be made in detail to the description of the embodiments as illustrated in the drawings, wherein like reference numbers indicate like parts throughout the several views.

Figure 2:
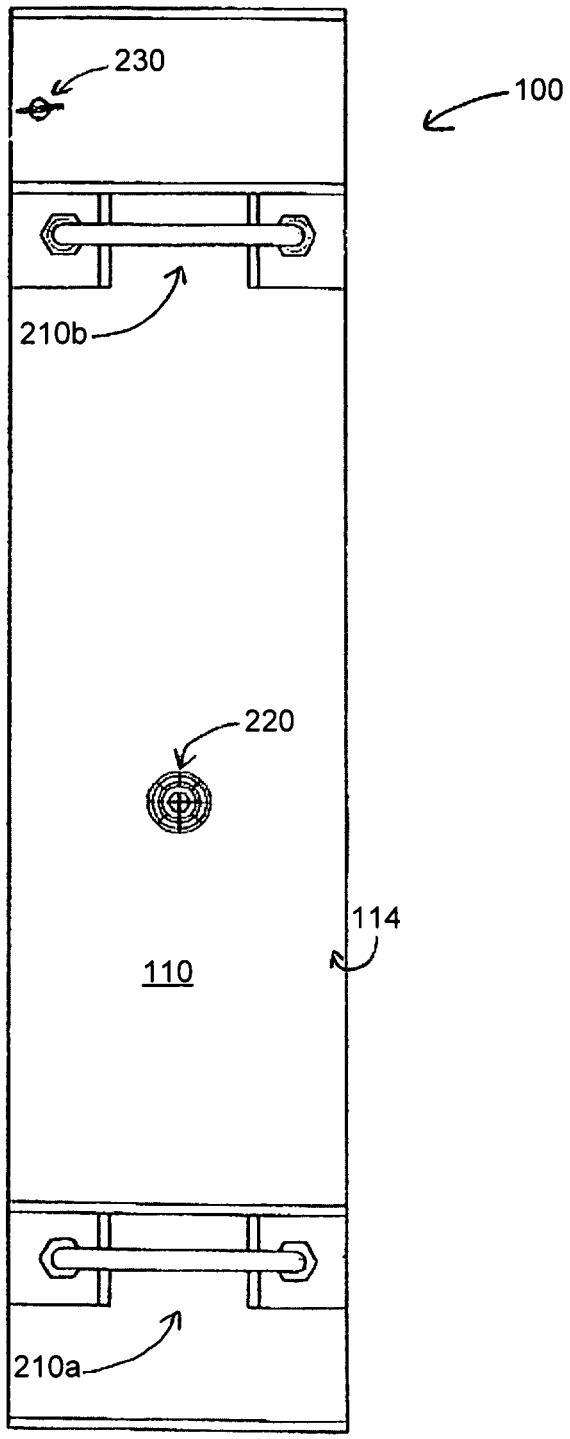
FIG. 2 is a rear view of the litter receptacle of FIG. 1.

FIGS. 1 and 2 depict an exemplary embodiment of a litter receptacle 100 as viewed from the side. The litter receptacle 100 includes a container 240 rotatably coupled to a support frame 110, which, in the embodiment of FIGS. 1 and 2, is a plate, via rotating coupler 220 such that the container may rotate about an axis of rotation 250 extending between the front 246 and back 244 of the container 240. The container 240 may be enclosed on its bottom 248, front 246, back 244 and two sides but the top 242 has an aperture or opening (750 in FIG. 7) for receiving litter into the container and removing litter out of the container.

Although the coupler 220 is depicted as a bolt, other couplers may be used, including but not limited to a pin.

A retention device 230 may be used to help hold the container in an upright position. The retention device 230 may be in communication with the support frame 110 and the container 240. In the embodiment depicted in FIG. 1 the retention device 230 is mounted to the support frame and is operable to releasably secure the container 240 to the support frame in a substantially upright position. The container is allowed to rotate about the rotating coupler and axis 250 when the container is released by the retention device. In other embodiments different retention devices may be used, including but not limited to, bolts, screws, and other types of pins.

The litter receptacle 100 may also include mounting couplers 210*a* and 210*b* attached to the back 114 of the support frame 110. Exemplary mounting couplers, as depicted in FIGS. 1, 2, 4, and 7 are u-bolts. U-bolts are particularly well suited for coupling the litter receptacle to round structures such as a pole, for example a pole for a parking meter. In other embodiments the mounting couplers may include, but not be limited to, screws or straight bolts. Screws and straight bolts allow the litter receptacle to be coupled to other structures, such as a wall.

Figure 3:
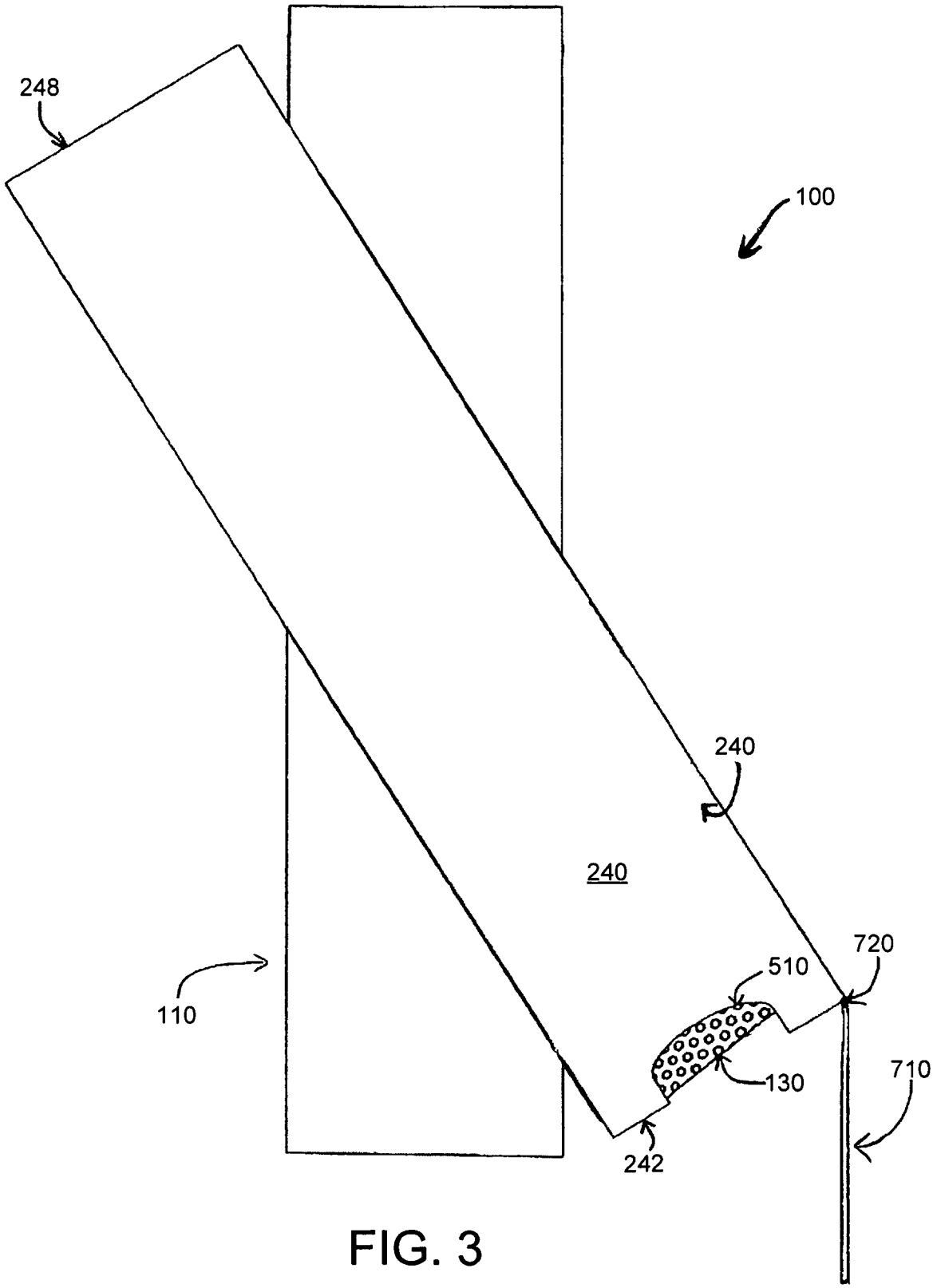
FIG. 3 is a front view of a litter receptacle of FIG. 1 in an emptying position.

Referring now to FIG. 3, an exemplary embodiment of a litter receptacle 100 of the present disclosure in a substantially inverted position is depicted. This position may also be referred to as an upside down position or an emptying position.

An optional lid 710 is coupled to the container 240 with a coupler 720 such that when the container is in a substantially upright position the lid covers at least a portion of the top of the container and when the container 240 is in an emptying position the lid 710 is at least partially open to allow the contents of the container to fall out. In the embodiment depicted in FIG. 3 the coupler 720 is a hinge.

The container 240 may include a cutout 510 in the upper portion of the container. When in an upright or vertical position the cutout 510 allows litter to be placed into the container. Additionally an extinguisher 130 may be located in an upper portion of the container 240 and in proximity to the cutout 510. Such an arrangement of the cutout and extinguisher may allow the lit end of a smoked consumer product, for example a cigarette or cigar, to be inserted though the cutout 510 and pressed against and/or rubbed into the extinguisher to smother the lit end of the smoked consumer product and aid in extinguishment.

Figure 7:
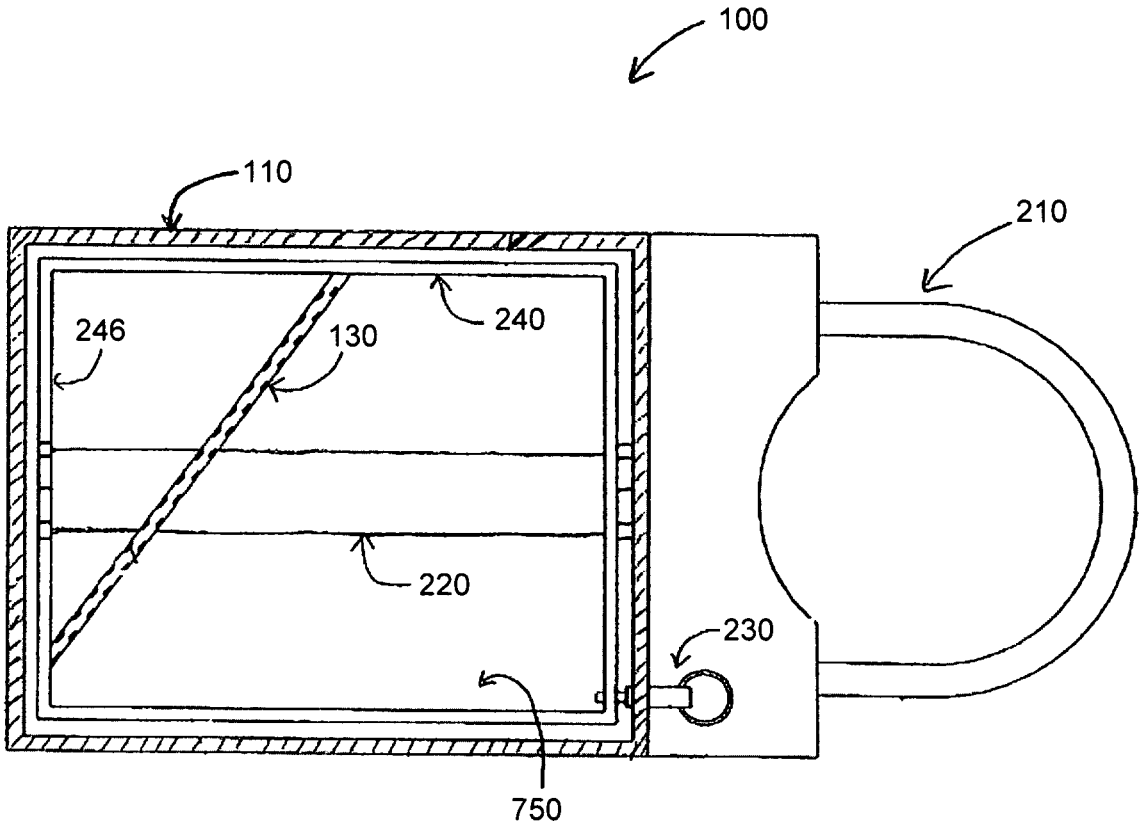
FIG. 7 is a cut away top view of the litter receptacle of FIG. 4 along A-A of FIG. 2.

The extinguisher 130 may be mounted in the container at an angle with respect to a side of the container such that a distance between the extinguisher and the cutout varies, see FIG. 7. By varying the distance between the cutout and a location on the extinguisher, the lit end of different lengths of smoked consumer products may be pressed against and/or rubbed into the extinguisher.

Although the embodiment shown in FIG. 3 depicts the cutout 510 as being located in the top portion of the front side 246 of the container 240 and in communication with the top 242 of the container 240, in other embodiments the cutout may be in other locations, including but not limited to, the back or sides of the container. In still other embodiments the cutout may be in a top portion of the container and not in communication with the top 246 of a container.

Figure 4:
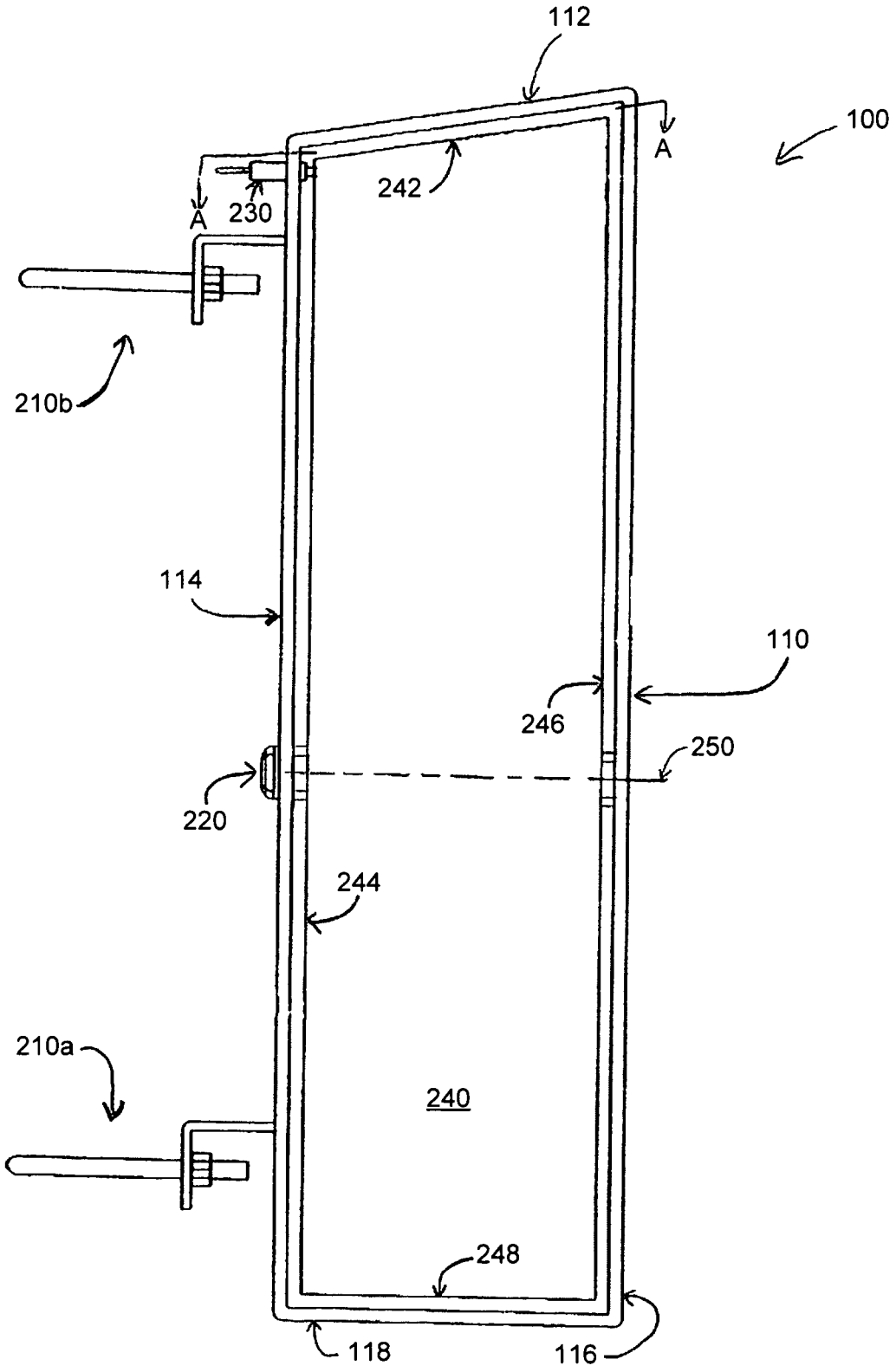
FIG. 4 is a side view of an exemplary embodiment of a litter receptacle of the present disclosure with a surrounding support frame.
Figure 5:
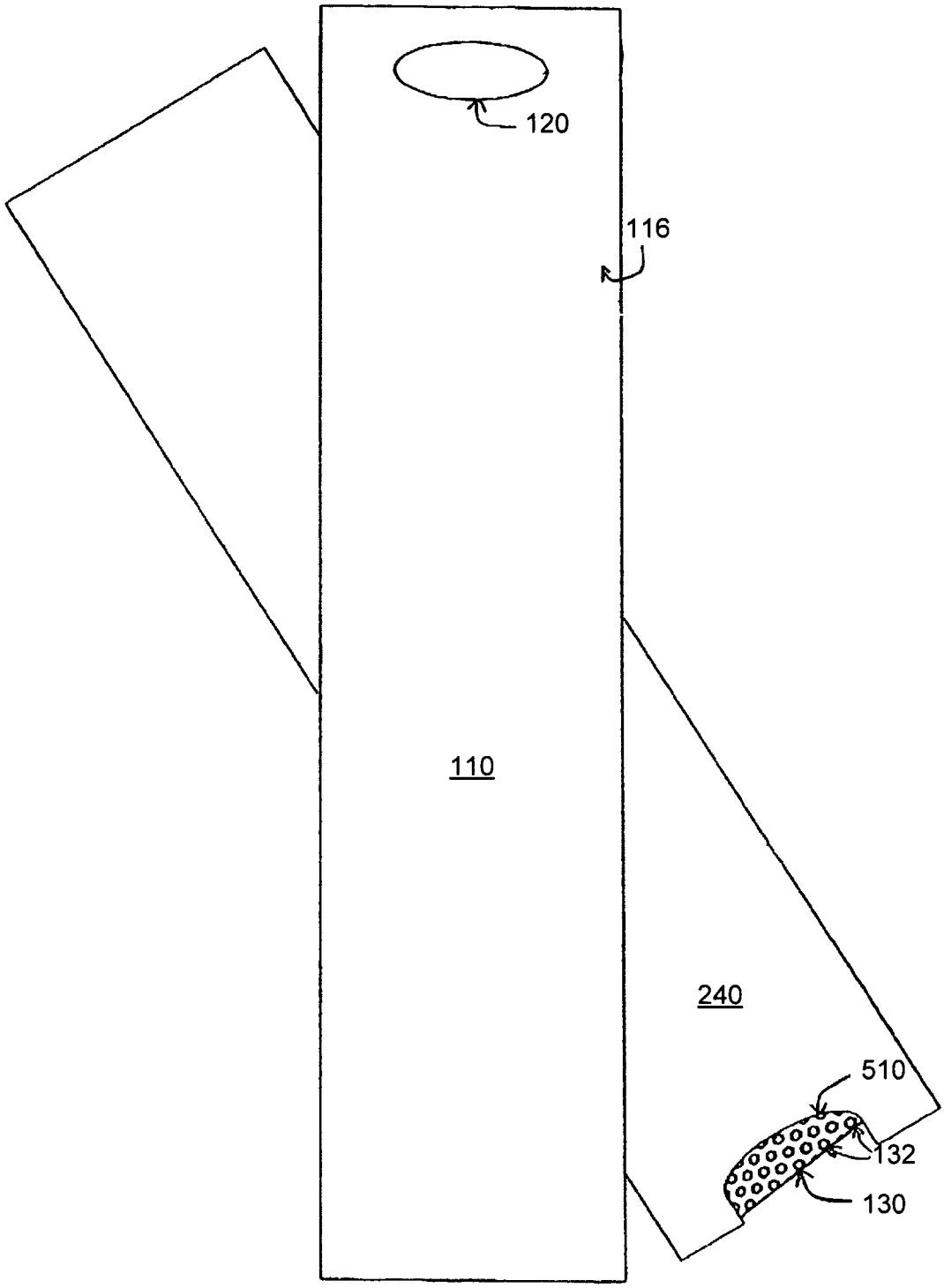
FIG. 5 is a front view of the litter receptacle of FIG. 4 in an emptying position.

Referring now to FIGS. 4 and 5, FIG. 4 depicts an exemplary litter receptacle 100 of the present disclosure as viewed from the side. The litter receptacle 100 includes a support frame 110 that includes a back 114, top 112, front 110, and bottom 118 that substantially surround the back 244, top 242, front 246, and bottom 248 of the container 240. The support frame may have open sides to allow the container to rotate about axis 250 between a substantially upright position as shown in FIG. 4 to an inverted or upside down position as shown in FIG. 5.

The container 240 is rotatably coupled to the support frame 110 with coupler 220 such that the container may rotate about an axis of rotation 250 extending between the front 246 and back 244 of the container 240. When in a substantially upright position, as depicted in FIG. 4, litter may be placed inside the container. When rotated into an inverted position such as the position shown in FIG. 5, the contents of the container may be emptied.

A retention device 230 may be used to help hold the container in an upright position. The embodiment of FIG. 4 depicts a spring-biased pin mounted to the outer frame 110 which is operable to engage the outer frame 110 and the container 240 and resist rotation of the container 240 relative to the outer frame 110. In other embodiments different retention devices may be used, including but not limited to bolts, screws, and pins.

The litter receptacle 100 includes mounting couplers 210*a* and 210*b* attached to the back 114 of the outer frame 110. Additionally, the top 112 of the outer frame 110 may be slanted to discourage the accumulation of rain and the placement of other objects on the frame.

Although depicted as having a top 112, bottom 118, front 116 and back 114 surrounding the top 242, front 246, bottom 248, and back 244 of the container 240, in other embodiments the outer frame may not surround the entire top, front, bottom and back of a container. For example the support frame may simply have a back, or may have a back and also a top which substantially covers the aperture 750 of the container 240, instead of a lid such as lid 710.

In FIG. 5, the container 240 is shown in a substantially inverted emptying position. In this position the contents of the receptacle may fall out due to the force of gravity allowing the container 240 to be emptied.

Additionally, the embodiment of FIG. 5 includes a cutout 510 in the top of the front side 246 of the container 240. This cutout is located and sized such that when the container is in an upright position, for example, cigarettes or cigars may be inserted through the aperture 120 and cutout 510 and extinguished on the extinguisher 130 and/or dropped into the container 240.

Additionally, although the extinguisher 130 is depicted as having round perforations 132, the perforations may be of many different shapes or the extinguisher may have no perforations at all.

Figure 6:
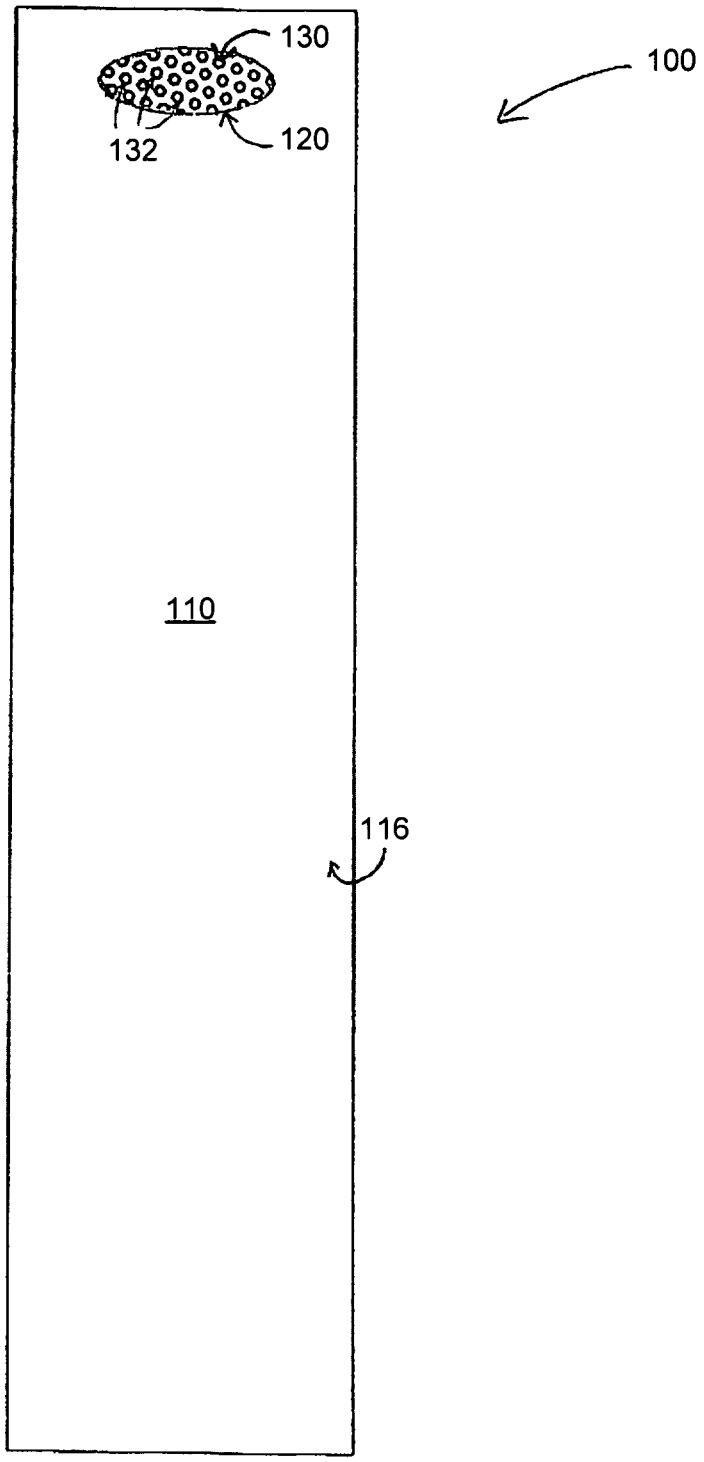
FIG. 6 is a front view of a litter receptacle of FIG. 4 in a vertical position.

Referring now to FIG. 6, there is depicted an exemplary embodiment of an outer frame 110 of a litter receptacle 100 of the present disclosure. In this embodiment the front 116 of the outer frame includes an aperture 120 through which, for example, cigarettes and other trash may be placed. When a container 240 that includes a cutout is in a vertical or upright position the aperture 120 of a support frame 110 is located in proximity to a cutout (such as cutout 510 in FIG. 5) such that litter may be placed through the aperture 120 and the cutout and into the container. Additionally the aperture 120 may be located in proximity to an extinguisher 130 such that the lit end of a smoked consumer product may be placed though the aperture and pressed against and/or rubbed into the extinguisher.

Referring now to FIG. 7, a top view of an exemplary litter receptacle of the present disclosure with the top of the outer frame cutaway may be seen. An extinguisher 130 is coupled to a container 240. In an exemplary embodiment the extinguisher 130 is a perforated metal plate and is welded to the inner wall of the container 240. Although the extinguisher is depicted as being angled with respect to the front wall 246 of the container, the angled arrangement is not required. Additionally, the extinguisher may not have perforations.

Additionally, although the container 240 is depicted as having a cross section of a four sided polygon which is substantially rectangular in shape, the container may have a cross section of a polygon with more or less sides or may not be a polygon at all, for example the container may have a circular cross-section, an oval or elliptical cross-section or an irregular cross-section.

In an exemplary implementation and method use of a litter receptacle of the present disclosure, the litter receptacle is mounted near a city sidewalk on a pole, for example, a light pole or a parking meter pole. Users insert their litter through an aperture in the container, in one embodiment the litter can consist of, for example, a lit cigarette or other smoking product, and users extinguish their smoking product by pressing and rubbing the lit end of the product against an optional extinguisher. Once extinguished, the users drop the product into the container.

When one wants to empty the container one may disengage the retention device and rotate the container into an inverted position allowing the litter to fall out of the container and into a larger trash receptacle for collecting the contents of several litter receptacles of the present disclosure. Once emptied, the container may be rotated back into a substantially upright orientation and engaged in such position to the support frame by the retention device.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A litter receptacle system, comprising:

a support frame including a top, bottom, a front side, and a back side opposed to the front side;

a container for receiving and storing litter, the container including a top, bottom and a side section;

a coupler, the coupler pivotally coupling the container to the support frame about an axis; and a retention device in communication with the support frame and the container, the retention device operable to secure the container to the support frame, wherein:

the container is held within the support frame by the coupler, the container adapted to be held within the support frame in an upright position to receive litter, and the coupler is positioned between the top and the bottom of the support frame, the top of the container being positioned above the coupler and the bottom of the container being positioned below the coupler when the container is held in an upright position, within the support frame, such that both the top and the bottom of the container are pivotable in a circular manner about and on opposite sides of the coupler, and the container adapted to pivot about the axis of the coupler to an upside down position in which the bottom of the container is above the coupler and the top of the container to remove litter from the container, wherein:

the side section of the container includes a front and a back, the front of the container positioned adjacent the front side of the support frame and the back of the container positioned adjacent the back side of the support frame and the container is designed to pivot about an axis extending from the front of the container to the back of the container when the container is positioned upright within the support frame and wherein the support frame further includes opposed side openings located in between the front and back side of the support frame and the container is positioned within the support frame such that the container is pivotable in a circular manner about the coupler in between the front and back side of the support frame and passing through the opposed side openings.

2. The system of claim 1, comprising:

further comprising a device attached to the support frame, the device designed for attaching the support frame of the litter receptacle system to a surface.

3. The system of claim 1, wherein the container includes an opening in an upper portion of the container allowing the container to receive and store litter.

4. The system of claim 1, further including mounting couplers attached to the support frame adapted to couple the support frame to a pole.

5. The system of claim 1, wherein:

the retention device is operable to releasably secure the container in a substantially upright position.

6. The system of claim 1 further comprising an extinguisher located within the container in an upper portion of the container when the container is held in an upright position.

7. The system of claim 1, wherein:

the container includes a cutout located in an upper portion of the container; and an extinguisher, against which a lit smoking product may be pressed, is located within the container in proximity to the cutout.

8. The system of claim 5 wherein:

the retention device is mounted to the support frame.

9. The system of claim 1 further comprising:

a hinge; and a lid;

wherein the hinge couples the lid to a top of the container for covering an opening in the top of the container.

10. The system of claim 1, wherein the surface is a vertical surface.

* * * * *